US011364598B2

(12) United States Patent
Kimura

(10) Patent No.: US 11,364,598 B2
(45) Date of Patent: Jun. 21, 2022

(54) WORKPIECE RECEIVING AND SUPPORTING DEVICE

(71) Applicant: FANUC CORPORATION, Yamanashi (JP)

(72) Inventor: Atsushi Kimura, Yamanashi (JP)

(73) Assignee: FANUC CORPORATION, Yamanashi (JP)

( * ) Notice: Subject to any disclaimer, the term of this patent is extended or adjusted under 35 U.S.C. 154(b) by 85 days.

(21) Appl. No.: 16/992,342

(22) Filed: Aug. 13, 2020

(65) Prior Publication Data

US 2021/0086330 A1 Mar. 25, 2021

(30) Foreign Application Priority Data

Sep. 25, 2019 (JP) ..... JP2019-174066

(51) Int. Cl.
*B25B 11/00* (2006.01)

(52) U.S. Cl.
CPC ..... *B25B 11/005* (2013.01)

(58) Field of Classification Search
CPC ... B23Q 3/02; B23Q 3/04; B23Q 3/06; B23Q 3/062; B23Q 3/063; B23Q 3/065; B23Q 3/088; B23Q 3/15; B23Q 3/152; B25B 11/00; B25B 11/02; B25B 11/002; B25B 11/005; B25J 15/0616
USPC ..... 269/21, 266, 289 mr
See application file for complete search history.

(56) References Cited

U.S. PATENT DOCUMENTS 3,293,739 A * 12/1966 Hoglund ..... B25B 11/005 156/304.6
4,088,312 A * 5/1978 Frosch ..... B25B 11/005 269/21
4,527,783 A * 7/1985 Collora ..... B25B 11/005 269/297
4,579,271 A * 4/1986 Fujita ..... B23K 37/04 228/49.1
5,364,083 A * 11/1994 Ross ..... B25B 11/005 269/21
5,647,706 A * 7/1997 Lehmler ..... B25B 11/005 269/21

(Continued)

FOREIGN PATENT DOCUMENTS

JP 2002-321181 A 11/2002
JP 2002321181 A * 11/2002

*Primary Examiner* — Lee D Wilson
*Assistant Examiner* — Jonathan G Santiago Martinez
(74) *Attorney, Agent, or Firm* — Studebaker & Brackett PC

(57) ABSTRACT

A workpiece receiving and supporting device that is configured to sequentially contact a plurality of types of different non-flat surfaces provided on a plurality of workpieces, and subsequently support the workpieces, includes: at least one positioning member that contacts the workpieces and positions the workpieces; and a plurality of surface copying members that contacts the workpieces positioned by the positioning member, and provided so as to be rotationally movable and linearly movable in accordance with surfaces of the workpieces, wherein the positioning member and the surface copying member include at least a contact portion that contacts the workpieces and supports the workpieces, and at least a sliding portion that is slidable in accordance with surfaces of the workpieces when contacting the workpieces on both sides of the contact portion.

5 Claims, 13 Drawing Sheets

(56) References Cited

U.S. PATENT DOCUMENTS

| | | | | |
|---|---|---|---|---|
| 7,028,391 | B2 * | 4/2006 | Pham-Van-Diep | H05K 13/0069 29/33 K |
| 7,235,757 | B2 * | 6/2007 | Lohwasser | B23K 20/126 219/121.48 |
| 8,499,433 | B2 * | 8/2013 | Matlack | B23Q 3/062 269/130 |
| 9,016,342 | B2 * | 4/2015 | Kobayashi | H01L 24/75 269/21 |
| 9,776,329 | B2 * | 10/2017 | Kai | B25J 9/104 |
| 2005/0260051 | A1 * | 11/2005 | Hamann | B64C 1/12 409/131 |
| 2006/0261533 | A1 * | 11/2006 | Freeland | B23Q 1/035 269/266 |
| 2008/0127474 | A1 * | 6/2008 | McAllister | B23Q 1/037 269/21 |
| 2015/0314424 | A1 * | 11/2015 | Kumakura | B25B 11/005 269/21 |
| 2018/0236638 | A1 * | 8/2018 | Olberg | B25H 1/00 |
| 2020/0391357 | A1 * | 12/2020 | Eto | B23Q 3/069 |

* cited by examiner

WORKPIECE RECEIVING AND SUPPORTING DEVICE

This application is based on and claims the benefit of priority from Japanese Patent Application No. 2019-174066, filed on 25 Sep. 2019, the content of which is incorporated herein by reference.

BACKGROUND OF THE INVENTION

Field of the Invention

The present invention relates to a workpiece receiving and supporting device.

Related Art

Conventionally, a support device has been known which suctions and supports a workpiece having warp by a plurality of suction bodies which follows the workpiece and is movably provided (for example, refer to Japanese Unexamined Patent Application, Publication No. 2002-321181).

Patent Document 1: Japanese Unexamined Patent Application, Publication No. 2002-321181

SUMMARY OF THE INVENTION

When supporting a workpiece having a predetermined surface shape, it is necessary to cause each of a plurality of suction portions contacting the workpiece to move so as to follow the surface shape of the workpiece by means of a rotating mechanism and a linear movement mechanism, thereby bringing each of the suction portions into close contact with the surface of the workpiece.

However, when sequentially supporting a workpiece having a plurality of types of different non-flat surfaces by a support device, there are the following problems. It should be noted that the workpiece having non-flat surfaces refers to a workpiece which has at least one of a curved surface and a sloped surface where a plurality of flat surfaces intersects on at least a part of the surface of the workpiece supported by contacting the support device. The workpiece having non-flat surfaces does not include a workpiece having a surface shape which is formed by an entire surface of the workpiece supported by contacting the support device having only a single flat surface (flat surface).

After a first workpiece is supported, the arrangement of the plurality of suction portions of the support device is maintained in a state following the non-flat surfaces of the first workpiece. Therefore, when a second workpiece having non-flat surfaces different from the non-flat surfaces of the first workpiece is supported by the same support device after the first workpiece is supported, even if each suction portion is pressed against the second workpiece, each suction portion cannot be moved along the non-flat surfaces of the second workpiece, and all the suction portions cannot be brought into close contact with the surface of the second workpiece in some cases.

Therefore, it is desired to be able to support each workpiece more reliably even when sequentially supporting the workpieces having different non-flat surfaces.

According to an aspect of the present disclosure relates to a workpiece receiving and supporting device that is configured to sequentially contact a plurality of types of different non-flat surfaces provided on a plurality of workpieces, and subsequently support the workpieces, which includes: at least one positioning member that contacts the workpieces and positions the workpieces; and a plurality of surface copying members that contacts the workpieces positioned by the positioning member, and provided so as to be rotationally movable and linearly movable in accordance with surfaces of the workpieces, wherein the positioning member and the surface copying member include at least a contact portion that contacts the workpieces and supports the workpieces, and at least a sliding portion that is slidable in accordance with surfaces of the workpieces when contacting the workpieces on both sides of the contact portion.

According to one aspect of the present disclosure, it is possible to provide a workpiece receiving and supporting device capable of supporting each workpiece more reliably even when sequentially supporting workpieces having different non-flat surfaces.

DETAILED DESCRIPTION OF THE INVENTION

Figure 1:
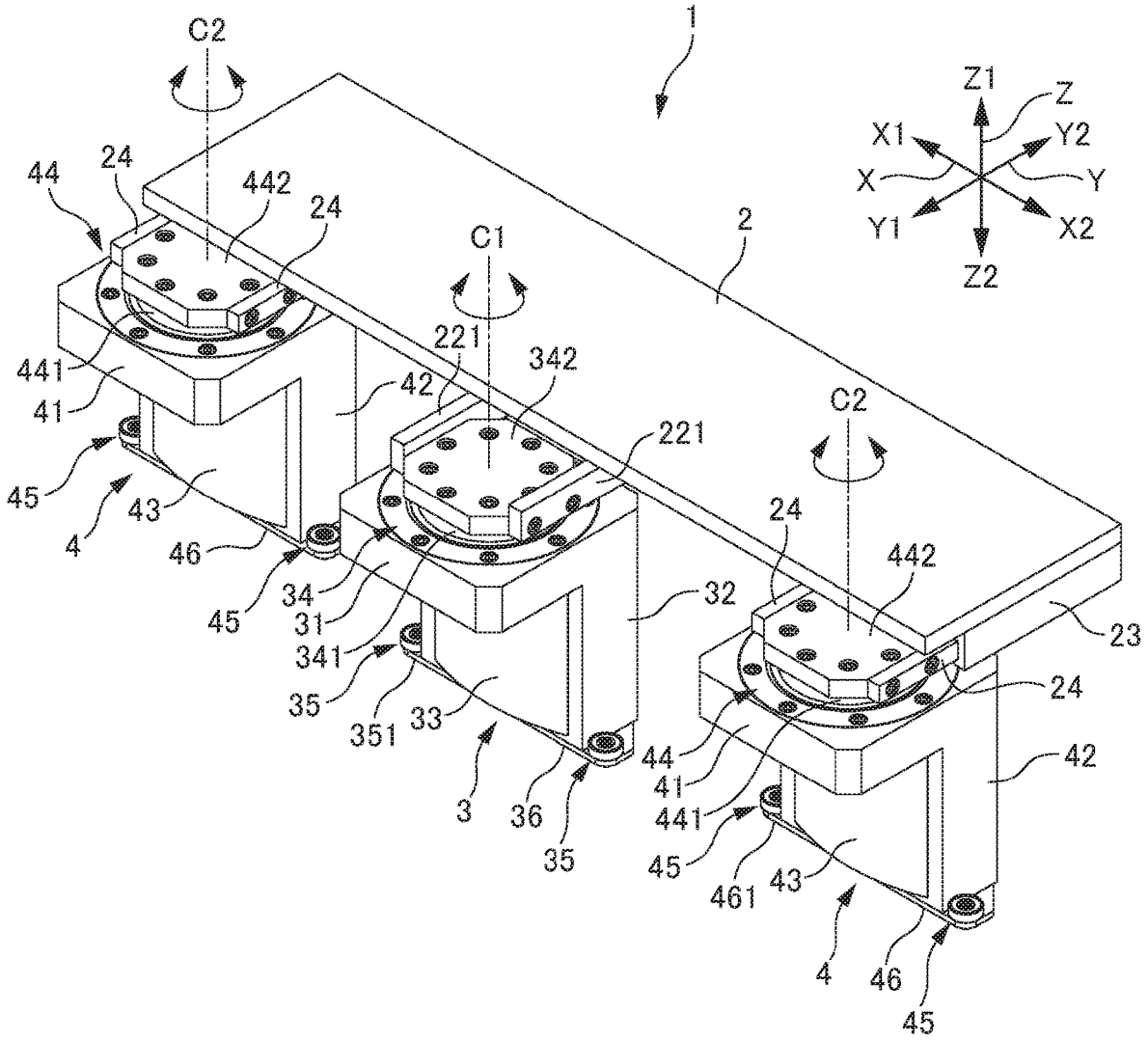
FIG. 1 is a perspective view showing a workpiece receiving and supporting device according to an embodiment of the present disclosure.
Figure 2:
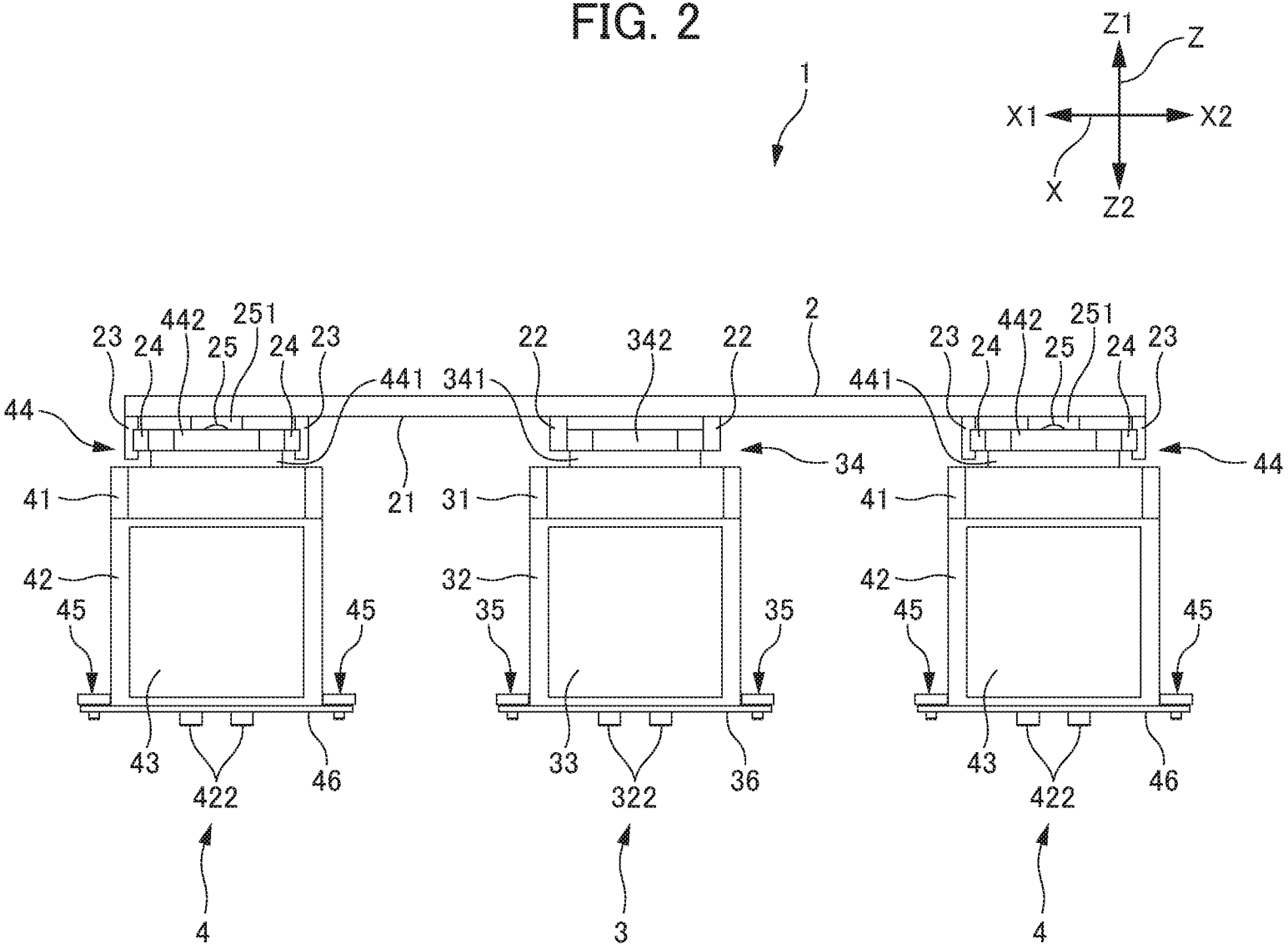
FIG. 2 is a front view showing the workpiece receiving and supporting device according to an embodiment of the present disclosure.
Figure 3:
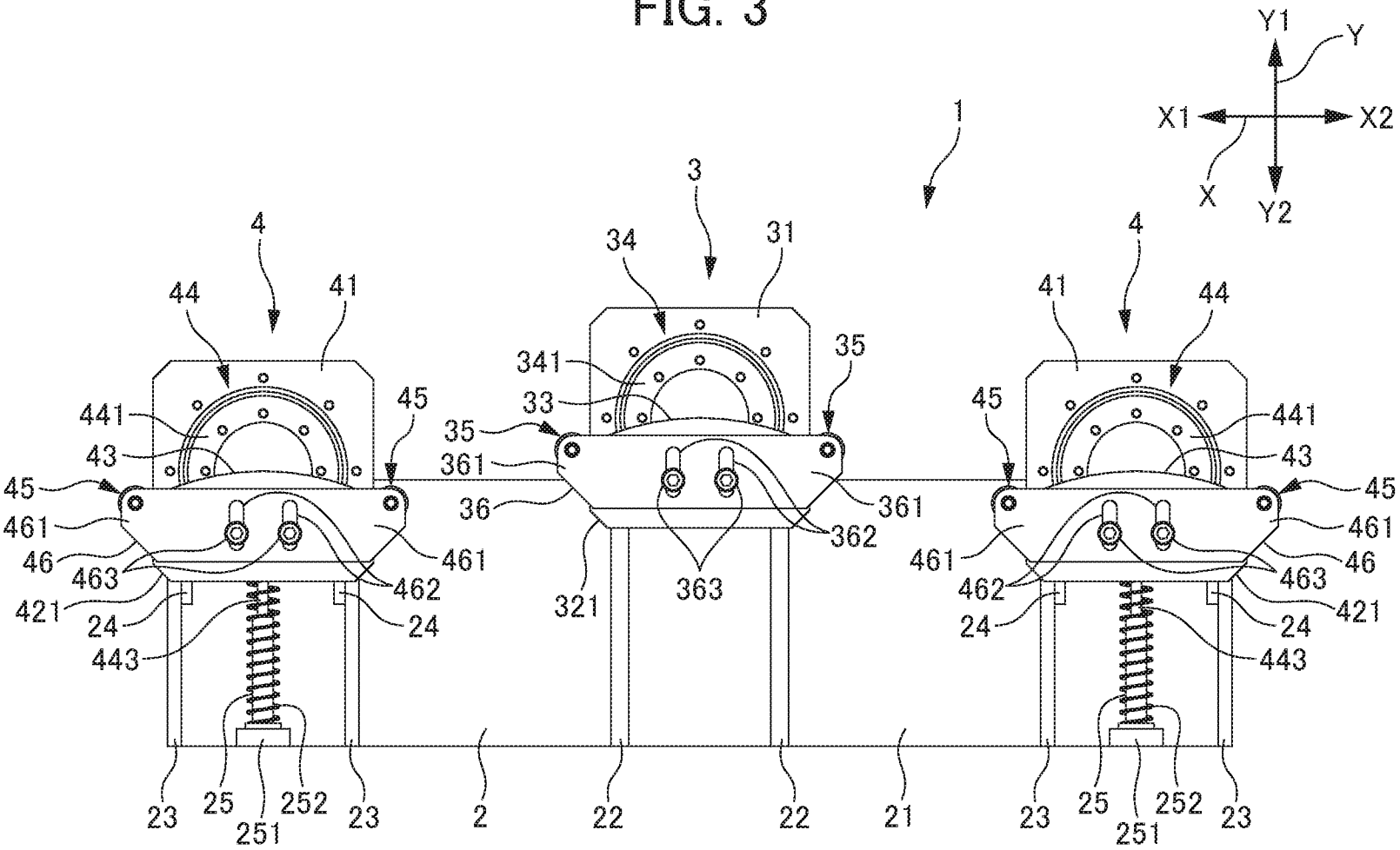
FIG. 3 is a bottom view showing the workpiece receiving and supporting device according to an embodiment of the present disclosure.

Hereinafter, an embodiment of a workpiece receiving and supporting device of the present disclosure will be described with reference to the drawings. As shown in FIGS. 1 to 3, a workpiece receiving and supporting device 1 includes a positioning member 3 and a surface copying member 4 which contact and support a workpiece on a mounting side surface 21 facing the Z2 direction of a common substrate 2 made of a rectangular flat plate. The workpiece receiving and supporting device 1 is attached to a tip end of a robot arm or crane (not shown) via the common substrate 2. The workpiece receiving and supporting device 1 is moved in any direction by the operation of the robot arm or crane, and sequentially contacts and supports a plurality of workpieces (for example, a first workpiece W1 and a second workpiece W2 described later) having a plurality of types of different non-flat surfaces by repetitive operation.

It should be noted that, among the directions shown in each figure, the X direction is a direction along the plane direction of the common substrate 2, and indicates the width direction of the workpiece receiving and supporting device 1. The Y direction is a direction along the plane direction of the common substrate 2, and indicates a direction perpendicular to the X direction. The Y1 direction indicates a direction in which the workpiece receiving and supporting device 1 moves toward the workpiece when supporting the workpiece. The Y2 direction indicates a direction in which the workpiece receiving and supporting device 1 having released the support of the workpiece moves when distanced from the workpiece. The Z direction indicates a direction perpendicular to the common substrate 2. The Z1 direction indicates a direction opposite to the Z2 direction.

Figure 5:
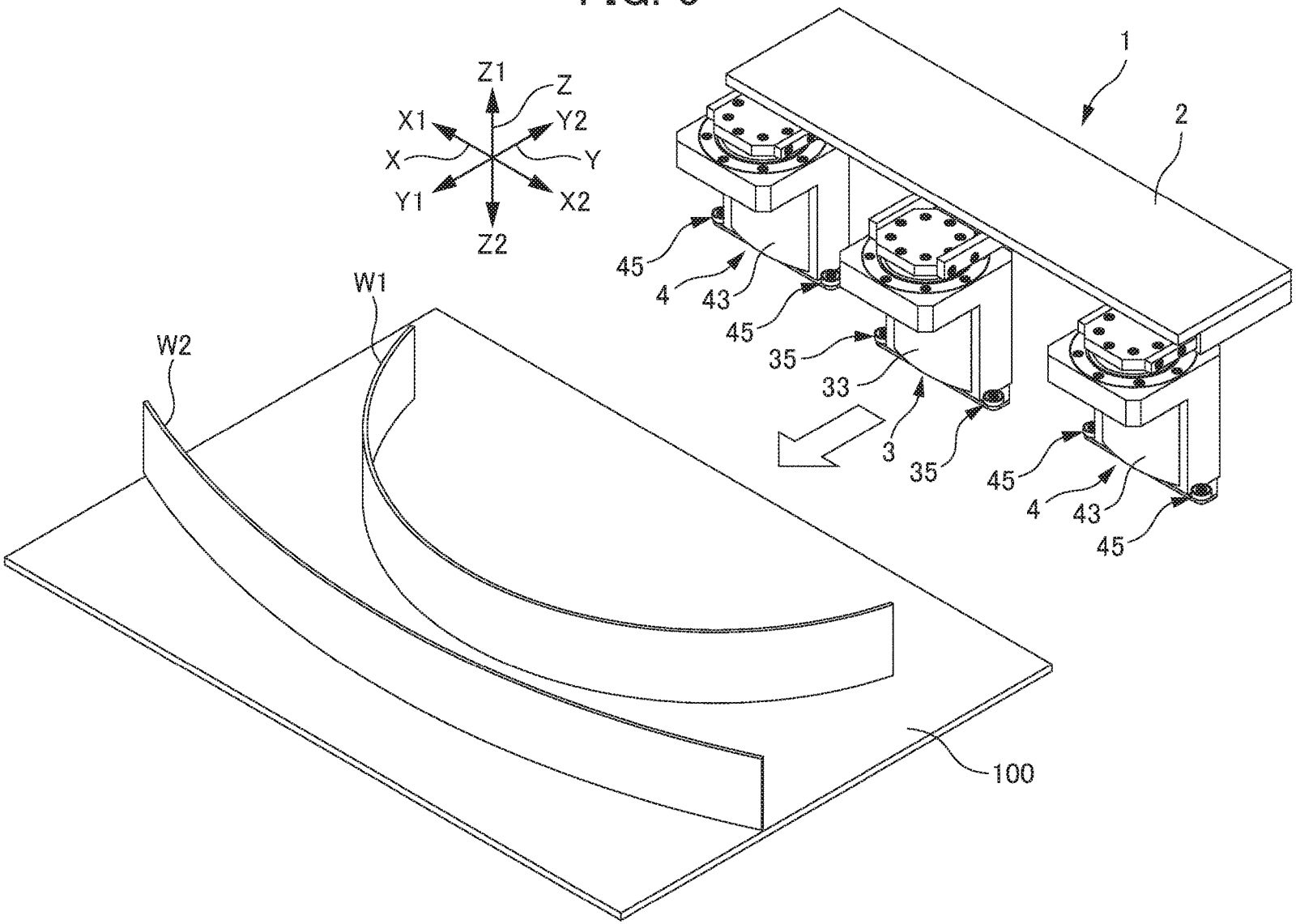
FIG. 5 is a perspective view explaining a state before supporting a first workpiece and a second workpiece having different curvatures by the workpiece receiving and supporting device according to an embodiment of the present disclosure.

The positioning member 3 is a member that contacts and supports a workpiece (refer to the first workpiece W1 and the second workpiece W2 shown in FIG. 5, etc.) and determines the position of the workpiece receiving and supporting device 1 with respect to the workpiece. The positioning member 3 is provided to be fixed so as not to be movable in any direction of X, Y, and Z with respect to the mounting side surface 21 of the common substrate 2. However, the positioning member 3 is rotatably movable at any angle around the axis C1 in accordance with the surface shape of the workpiece. The axis C1 is arranged along the Z direction perpendicular to the mounting side surface 21 of the common substrate 2.

Similarly to the positioning member 3, the surface copying member 4 is a member that contacts and supports the workpiece. The surface copying member 4 is provided so as not to be movable in the X direction and the Z direction with respect to the mounting side surface 21 of the common substrate 2. However, the surface copying member 4 is provided so as to be linearly movable along the Y direction, and is provided so as to be rotatably movable at any angle around the axis C2 along the surface shape of the workpiece. Similarly to the axis C1, the axis C2 is disposed along the Z direction perpendicular to the mounting side surface 21 of the common substrate 2.

The workpiece receiving and supporting device 1 of the present embodiment includes a positioning member 3, and two surface copying members 4 and 4 disposed on both sides of the positioning member 3, respectively. However, the positioning member 3 is not limited to one. Two or more positioning members 3 may be arranged between adjacent surface copying members 4 and 4. Furthermore, two or more surface copying members 4 may be disposed on one side so as to sandwich the positioning member 3.

Next, a specific structure of the positioning member 3 and the surface copying member 4 will be described. The positioning member 3 and the surface copying member 4 have the same structure except for differing from each other in that they are provided so as to be linearly movable or not with respect to the common substrate 2. Therefore, in the following description, the structure of the positioning member 3 and the surface copying member 4 will be described together with reference numerals.

The positioning member 3 and the surface copying member 4 include base portions 31 and 41, support plate portions 32 and 42, contact portions 33 and 43, rotating mechanism portions 34 and 44, and sliding portions 35 and 45, respectively.

The base portions 31 and 41 are portions for attaching the positioning member 3 and the surface copying member 4 to the common substrate 2. The base portions 31 and 41 are formed in a substantially square shape when viewed in the Z direction, and are arranged substantially parallel to the mounting side surface 21 of the common substrate 2.

The support plate portions 32 and 42 are portions for supporting the contact portions 33 and 43. As shown in FIG. 1 and FIG. 3, in an initial state in which the workpiece receiving and supporting device 1 does not start supporting the workpiece, the support plate portions 32 and 42 extend in the Z2 direction perpendicular to the base portions 31 and 41 from the end of the Y2 direction side of the base portions 31 and 41.

The contact portions 33 and 43 are portions that contact the workpiece, and suction and support the workpiece. The contact portions 33 and 43 are provided in a rectangular shape on the side surfaces of the support plate portions 32 and 42 facing in the Y1 direction in the initial state of the abovementioned workpiece receiving and supporting device 1. As shown in FIG. 3, the contact portions 33 and 43 are curved along the X direction so as to protrude slightly in the Y1 direction. The contact portions 33 and 43 are not curved in the Z direction.

The contact portions 33 and 43 of the present embodiment include magnets that attract metal workpieces by magnetic force. The contact portions 33 and 43 themselves may be formed by magnets, or alternatively, magnets may be disposed inside the contact portions 33 and 43. As the magnets, it is possible to use an electromagnet that generates magnetic force by energizing when attracting the workpiece.

The rotating mechanism portions 34 and 44 are provided at the center portions of the base portions 31 and 41. The rotating mechanism portions 34 and 44 include rotating disks 341 and 441 which are provided so as to be freely rotatable at any angle around the axes C1 and C2 with respect to the base portions 31 and 41, and fixing plates 342 and 442 which are fixed to the upper surface of the rotating disks 341 and 441 (a surface opposite to the support plate portion 32 and 42, a side surface facing in the Z1 direction). The fixing plates 342 and 442 are portions that respectively fix the positioning member 3 and the surface copying member 4 to the common substrate 2. The fixing plates 342 and 442 are integral with the rotating disks 341 and 441, and are rotatable about the axes C1 and C2 with respect to the base portions 31 and 41.

The sliding portions 35 and 45 are respectively disposed on both sides in the width direction (the X direction) of the workpiece receiving and supporting device 1 in the contact portion 33 and 43. More specifically, support plates 36 and 46 that support the sliding portions 35 and 45 are attached to the lower end surfaces 321 and 421 (an end surface opposite to the common substrate 2, the end surface facing in the Z2 direction) of the support plate portions 32 and 42 of the positioning member 3 and the surface copying member 4. The support plates 36 and 46 have a width (the width along the X direction) protruding from both sides of the support plate portions 32 and 42, respectively. The sliding portions 35 and 45 are disposed on the projecting portions 361 and 461 of the support plates 36 and 46 protruding from both sides of the support plate portion 32 and 42, respectively.

Figure 4:
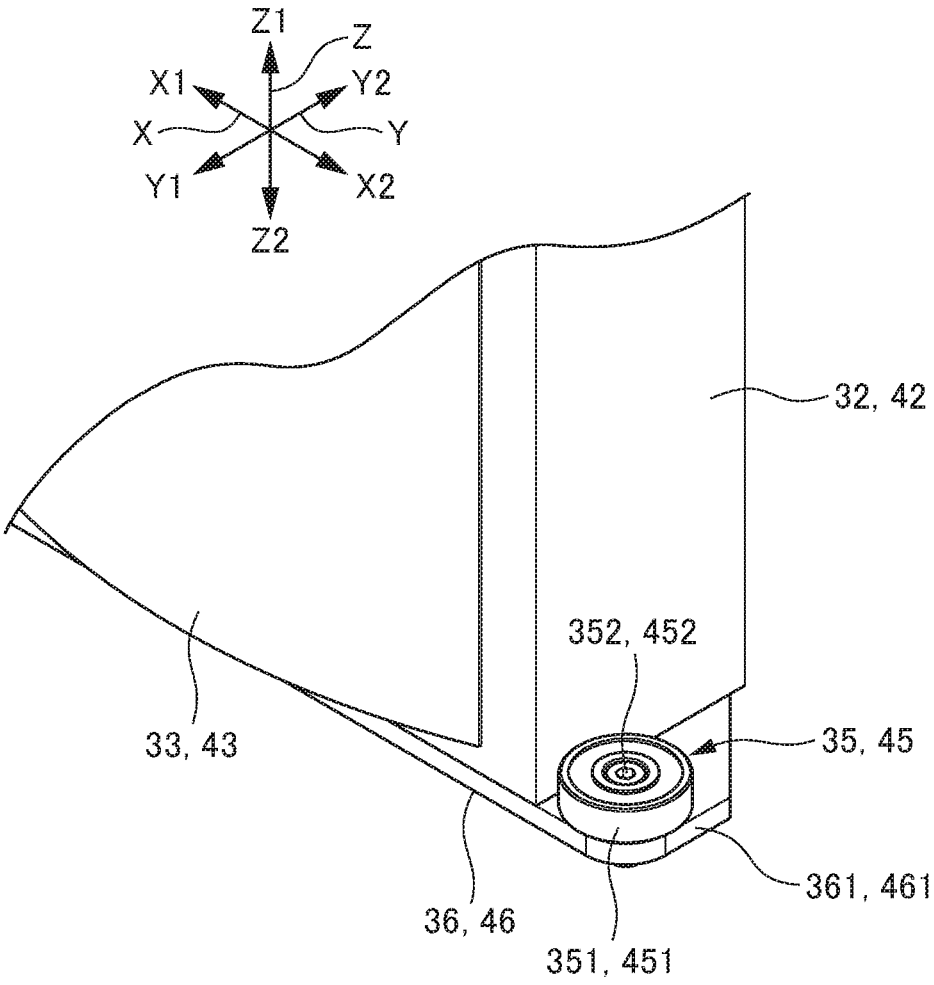
FIG. 4 is an enlarged view showing a common part of a positioning member and a surface copying member in the workpiece receiving and supporting device according to an embodiment of the present disclosure.

The sliding portions 35 and 45 of the present embodiment are configured by rollers 351 and 451 which are rotating members. The rollers 351 and 451 are rotatably mounted about rotary axes 352 and 452 extending from the protruding portions 361 and 461 in the Z1 direction. As shown in FIG. 3 and FIG. 4, the outer diameters of the rollers 351 and 451 are set so as to protrude from the periphery of the projecting portions 361 and 461 in the Y1 direction and toward the side of the positioning member 3 and the surface copying member 4 along the X direction. Therefore, when the workpiece approaches the support plates 36 and 46, the workpiece contacts the rollers 351 and 451; however, the workpiece does not contact the support plates 36 and 46. When the rollers 351 and 451 and the workpiece move relative to each other after the rollers 351 and 451 contact the workpiece, the rollers 351 and 451 are easily rotatable. Therefore, the change in the relative position between the surface copying member 4 and the workpiece is smoothly performed by the rotation of the rollers 351 and 451.

The support plates 36 and 46 are fixed to the lower end surfaces 321 and 421 of the support plate portion 32 and 42 by fixing screws 363 and 463 inserted into the screw insertion holes 362 and 462. As shown in FIG. 3, the screw insertion holes 362 and 462 are long holes that are long in the Y direction in the initial state of the workpiece receiving and supporting device 1. Therefore, it is possible for the support plates 36 and 46 to adjust the position in the Y direction with respect to the support plate portions 32 and 42. Thus, it is possible for the positioning member 3 and the surface copying member 4 to adjust the optimal positions of the sliding portions 35 and 45 relative to the contact portions 33 and 43 in accordance with conditions such as the size, the curvature, etc. of the workpiece to be supported.

Next, the fixing structures of the positioning member 3 and the surface copying member 4 with respect to the common substrate 2 will be described. The positioning member 3 is fixed to the common substrate 2 via a fixing plate 342. As shown in FIG. 1 to FIG. 3, a pair of parallel mounting arms 22 and 22 extending along the Y direction is provided on the mounting side surface 21 of the common substrate 2. The interval of the mounting arms 22 and 22 is equal to the width of the fixing plate 342. As shown in FIG. 1, the mounting arms 22 and 22 respectively have extending portions 221 and 221 extending in the Y1 direction with respect to the common substrate 2. The fixing plate 342 of the positioning member 3 is fixed by screws or the like in a state being sandwiched between the pair of extending portions 221 and 221. Thus, the positioning member 3 is disposed so that substantially the entire base portion 31 protrudes in the Y1 direction from the common substrate 2 with respect to the common substrate 2 and, at this position, is rotatably movable about the axis C1 by the rotating mechanism portion 34.

The surface copying member 4 is fixed to the common substrate 2 via a fixing plate 442. As shown in FIG. 2 and FIG. 3, a pair of parallel guide rails 23 and 23 extending along the Y direction is provided at the mounting side surface 21 of the common substrate 2. Sliding arm portions 24 and 24 are slidably accommodated along the Y direction at the guide rails 23 and 23, respectively. The interval of the sliding arm portions 24 and 24 is equal to the width of the fixing plate 442. The fixing plate 442 of the surface copying member 4 is fixed by screws or the like, in a state being sandwiched between the pair of sliding arm portions 24 and 24. Thus, the surface copying member 4 is linearly movable parallel to the Y direction along the guide rails 23 and 23 with respect to the common substrate 2, and is rotatably movable about the axis C2 by the rotating mechanism portion 44.

As shown in FIG. 3, a guide rod 443 extending in the Y2 direction parallel to the mounting side surface 21 of the common substrate 2 is provided at the end of the Y2 direction side of the fixing plate 442 in the surface copying member 4. As shown in FIG. 3, a guide cylindrical portion 25 that allows the guide rod 443 to be inserted thereinto is provided between the pair of guide rails 23 and 23 at the mounting side surface 21. The guide cylindrical portion 25 is fixed to the mounting side surface 21 along the Y direction by the mounting block 251 provided on the end of the Y2 direction side.

Between the fixing plate 442 and the mounting block 251, a coil spring 252 is provided. The coil spring 252 is disposed on the outer periphery of the guide rod 443 and the guide cylindrical portion 25, and constantly applies a biasing force in a direction away from the mounting block 251 with respect to the fixing plate 442. Therefore, as shown in FIG. 1 and FIG. 3, in the initial state of the workpiece receiving and supporting device 1 that does not support the workpiece, the surface copying member 4 is disposed at the most protruding position in the Y1 direction with respect to the common substrate 2 by the biasing force of the coil spring 252. The surface copying member 4 is further linearly movable in the Y2 direction by compressing the coil spring 252 from its position.

It should be noted that the surface copying member 4 which most protrudes in the Y1 direction by the biasing force of the coil spring 252 is disposed to be retracted slightly toward the common substrate 2 side more than the positioning member 3. That is, in the initial state of the workpiece receiving and supporting device 1 which does not support the workpiece, regarding the position of the positioning member 3 and the surface copying member 4 along the Y direction, the positioning member 3 is protruding most in the Y1 direction.

Next, a description will be given of the operation when sequentially supporting the first workpiece W1 and the second workpiece W2 having curved surfaces of different curvatures by the repetitive operation of the workpiece receiving and supporting device 1 with reference to FIGS. 5 to 11. The first workpiece W1 and the second workpiece W2 shown in FIG. 5 are both metal plate materials curved in an arc shape. The curvature of the first workpiece W1 is greater than the curvature of the second workpiece W2. Therefore, the first workpiece W1 and the second workpiece W2 have different non-flat surfaces. The first workpiece W1 and the second workpiece W2 are arranged on a workpiece placing portion 100 in the order of the first workpiece W1 and the second workpiece W2 from the side close to the workpiece receiving and supporting device 1, with concave curved surfaces W1*a* and W2*a* facing the workpiece receiving and supporting device 1 side, respectively.

The workpiece receiving and supporting device 1 before first supporting the first workpiece W1 is in an initial state as shown in FIGS. 1 and 3. Therefore, the surface copying members 4 and 4 are disposed at positions protruding in the Y1 direction with respect to the common substrate 2 by the biasing force of the coil spring 252. The contact portions 33 and 43 of the positioning member 3 and the surface copying member 4 in the initial state both face in the Y1 direction so as to face the first workpiece W1.

Figure 6:
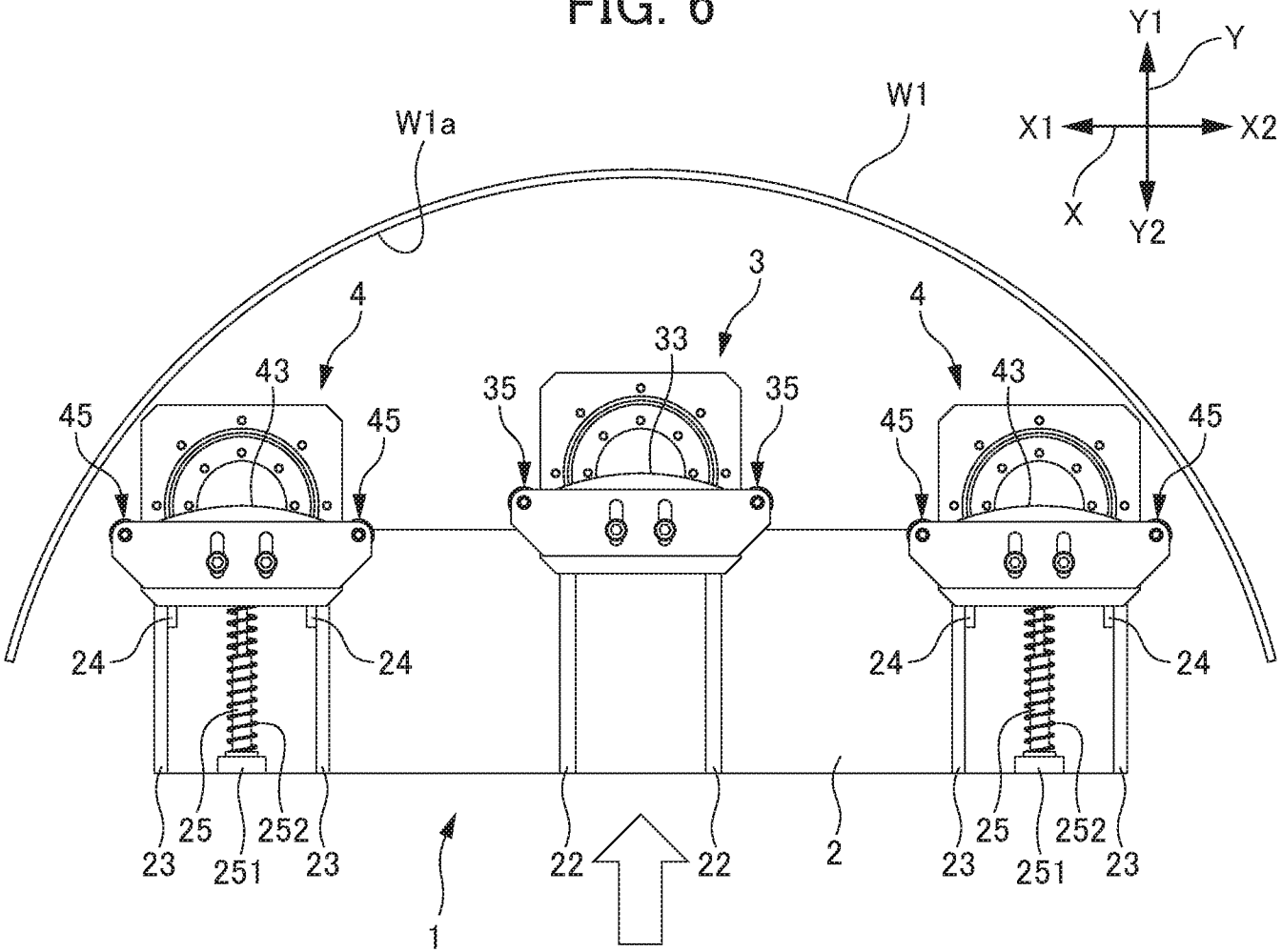
FIG. 6 is a bottom view showing a state starting to support a first workpiece by the workpiece receiving and supporting device according to an embodiment of the present disclosure.

As shown in FIG. 6, the workpiece receiving and supporting device 1 moves linearly in the Y1 direction toward the first workpiece W1 by a robot arm, a crane, or the like (not shown). At this time, the positioning member 3 at the center approaches the vicinity of the top of the central portion of the first workpiece W1 from the concave curved surface W1*a* side, and the surface copying members 4 and 4 approach the vicinity of both ends of the first workpiece W1 from the concave curved surface W1*a* side. Since the first workpiece W1 is largely curved in an arc shape, in the workpiece receiving and supporting device 1, the sliding portions 45 and 45 disposed on the outer side of the surface copying members 4 (i.e., on a side opposite to the positioning member 3) first contact the concave curved surface W1*a* of the first workpiece W1.

As shown in FIG. 4, the sliding portion 45 is configured by the rotatable roller 451. Therefore, when the workpiece receiving and supporting device 1 further moves in the Y1 direction after the sliding portions 45 and 45 of the surface copying members 4 and 4 contact the concave curved surface W1*a* of the first workpiece W1, the sliding portions 45 and 45 smoothly slide (roll) toward both ends of the first workpiece W1 in the width direction (the X direction) following the concave curved surface W1*a* of the first workpiece W1 by the rotation of the rollers 451 and 451. As a result, the surface copying members 4 and 4 move to rotate around the axis C2 (see FIG. 1) by the rotating mechanism portion 44 so that the contact portions 43 and 43 face the concave curved surface W1*a*. At the same time, the surface copying members 4 and 4 are pressed against the first workpiece W1 to compress the coil springs 252 and 252, and gradually linearly move in the Y2 direction along the guide rails 23 and 23.

Figure 7:
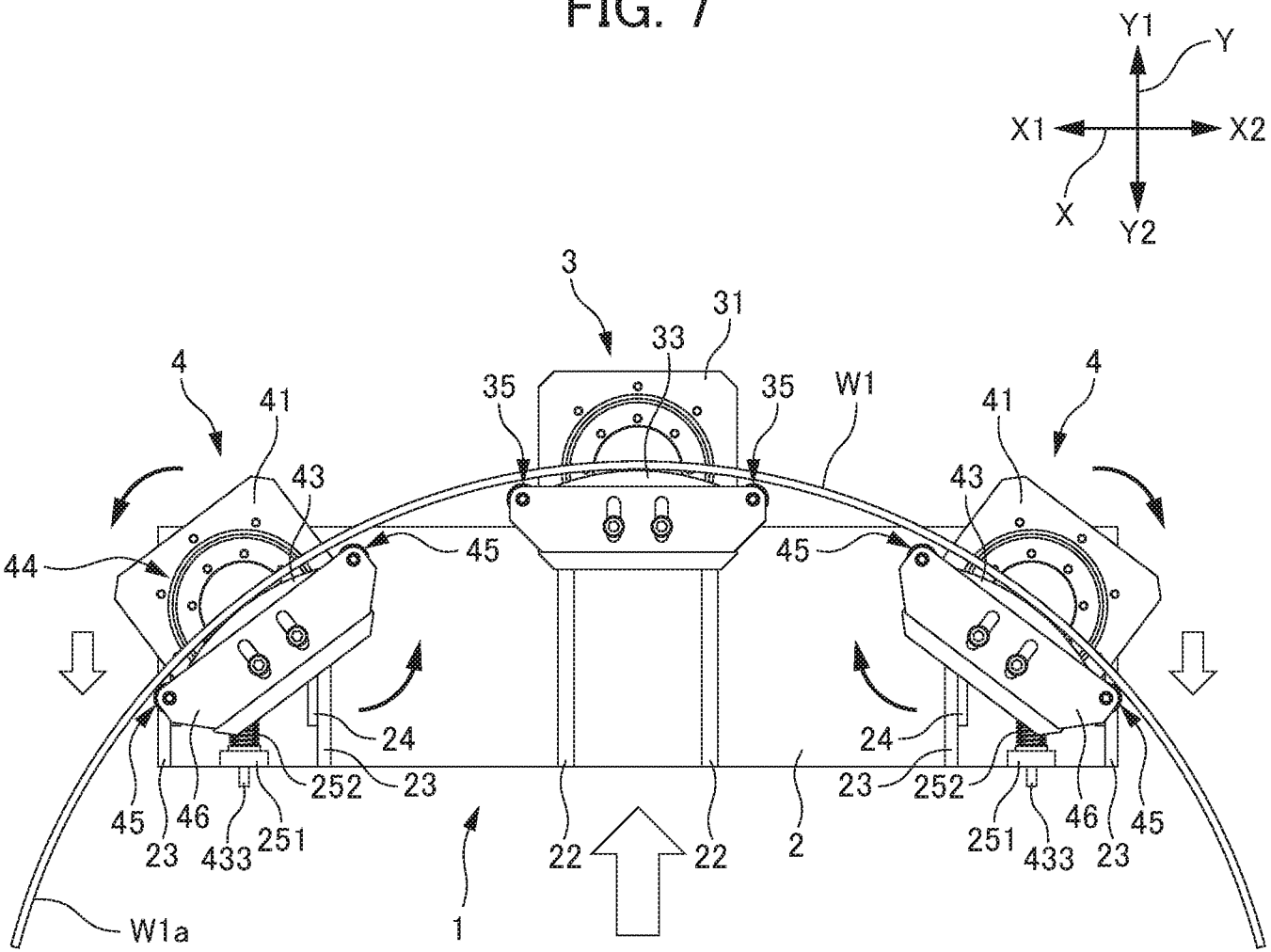
FIG. 7 is a bottom view showing a state having started supporting the first workpiece by the workpiece receiving and supporting device according to an embodiment of the present disclosure.
Figure 8:
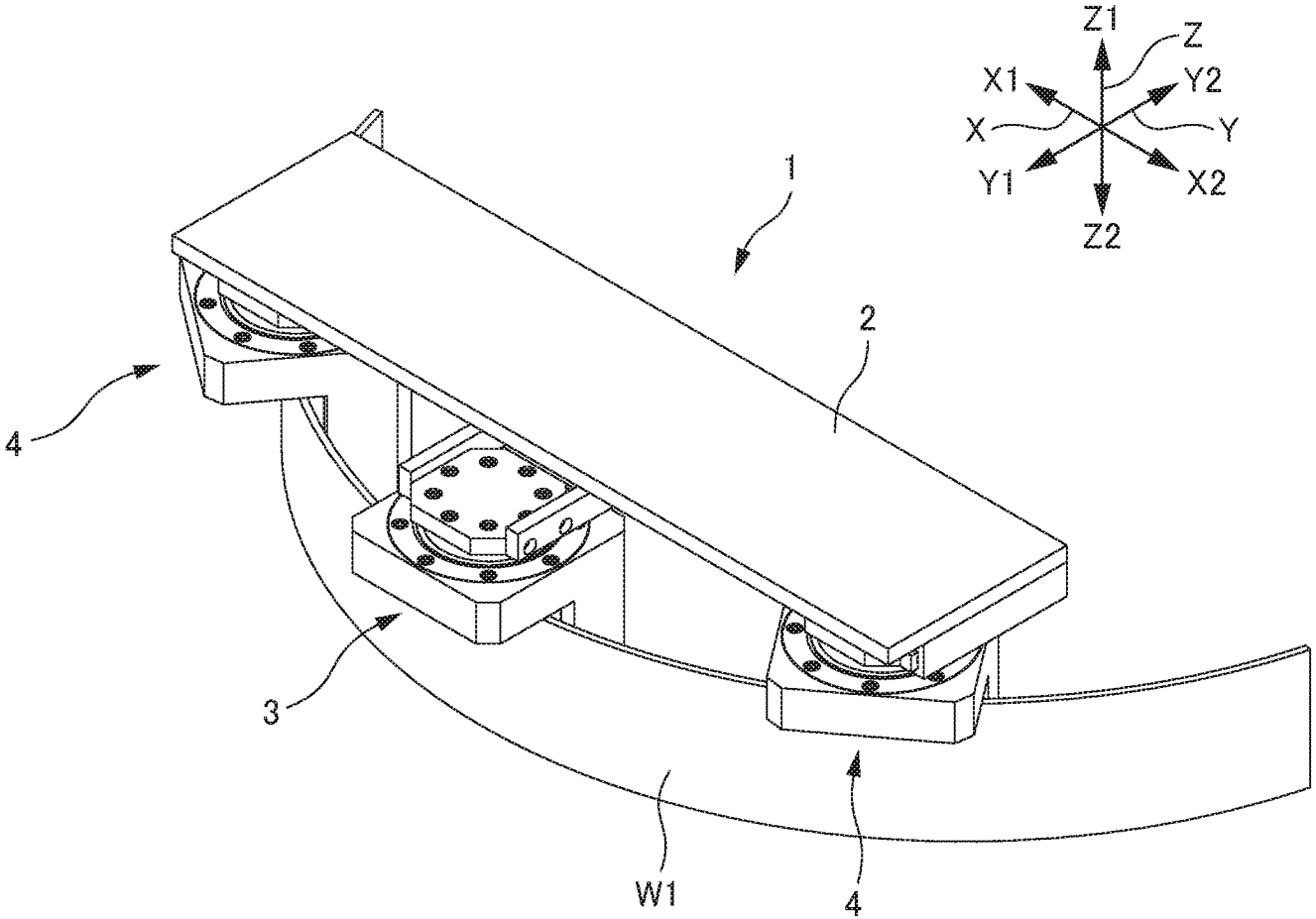
FIG. 8 is a perspective view showing a state having supported the first workpiece by the workpiece receiving and supporting device according to an embodiment of the present disclosure.

As shown in FIG. 7 and FIG. 8, when the contact portion 33 of the positioning member 3 contacts the concave curved surface W1*a* of the first workpiece W1, the position of the workpiece receiving and supporting device 1 with respect to the first workpiece W1 is determined. At this time, the surface copying members 4 and 4 are rotated by approximately 45 degrees in opposite directions with respect to the initial state in accordance with the concave curved surface W1*a* of the first workpiece W1. Therefore, the contact portions 43 and 43 of the surface copying members 4 and 4 also contact the concave curved surface W1*a*. The first workpiece W1 in contact with each of the contact portions 33, 43, and 43 is attracted and supported by the contact portions 33, 43, and 43 by the magnetic force generated by energization. Thereafter, by the workpiece receiving and supporting device 1 being moved by the operation of a robot arm, a crane, or the like, the first workpiece W1 is conveyed to a predetermined position.

Figure 9:
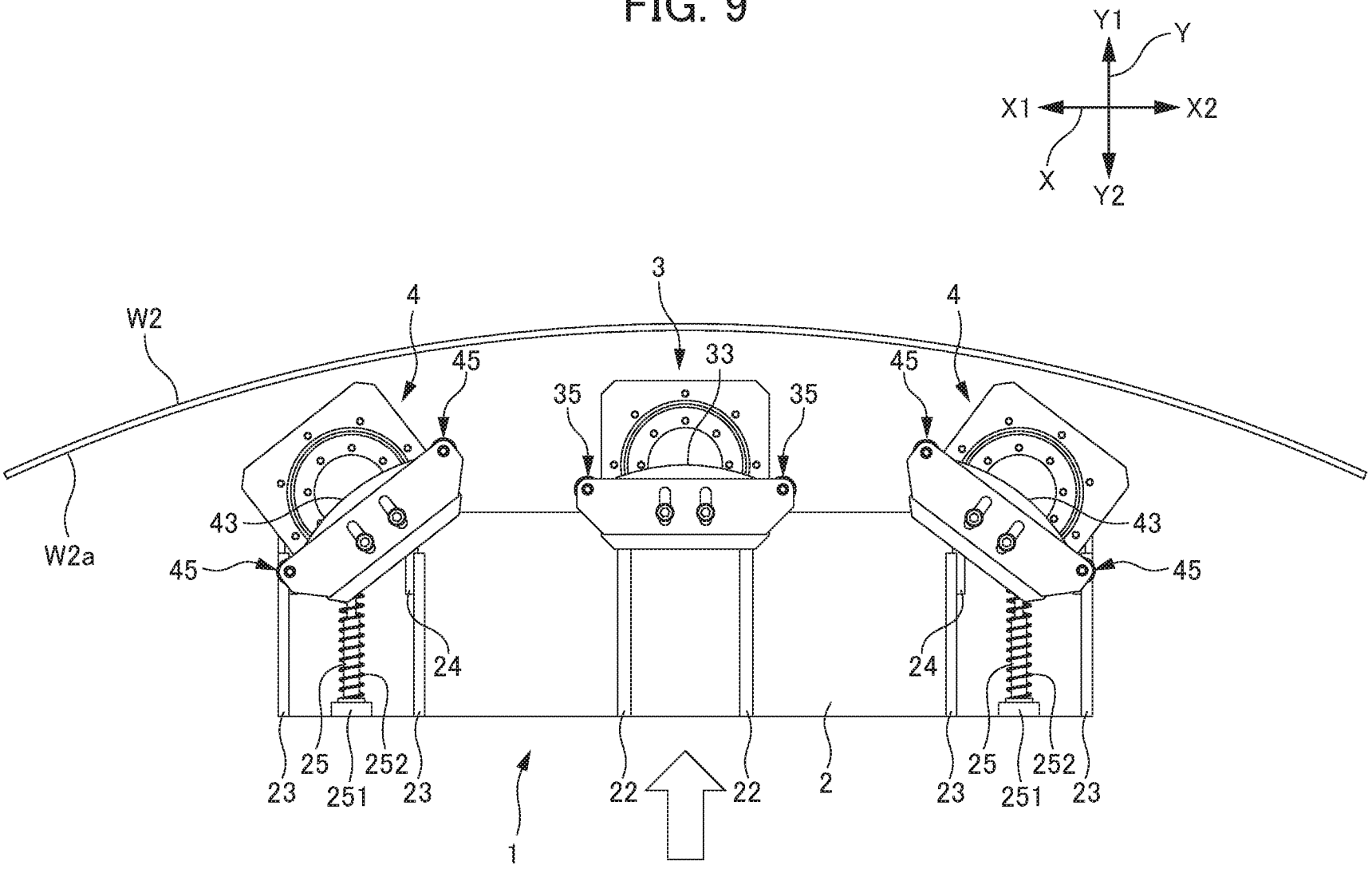
FIG. 9 is a bottom view showing a state starting to support a second workpiece having a different curvature after supporting the first workpiece by the workpiece receiving and supporting device according to an embodiment of the present disclosure.
Figure 10:
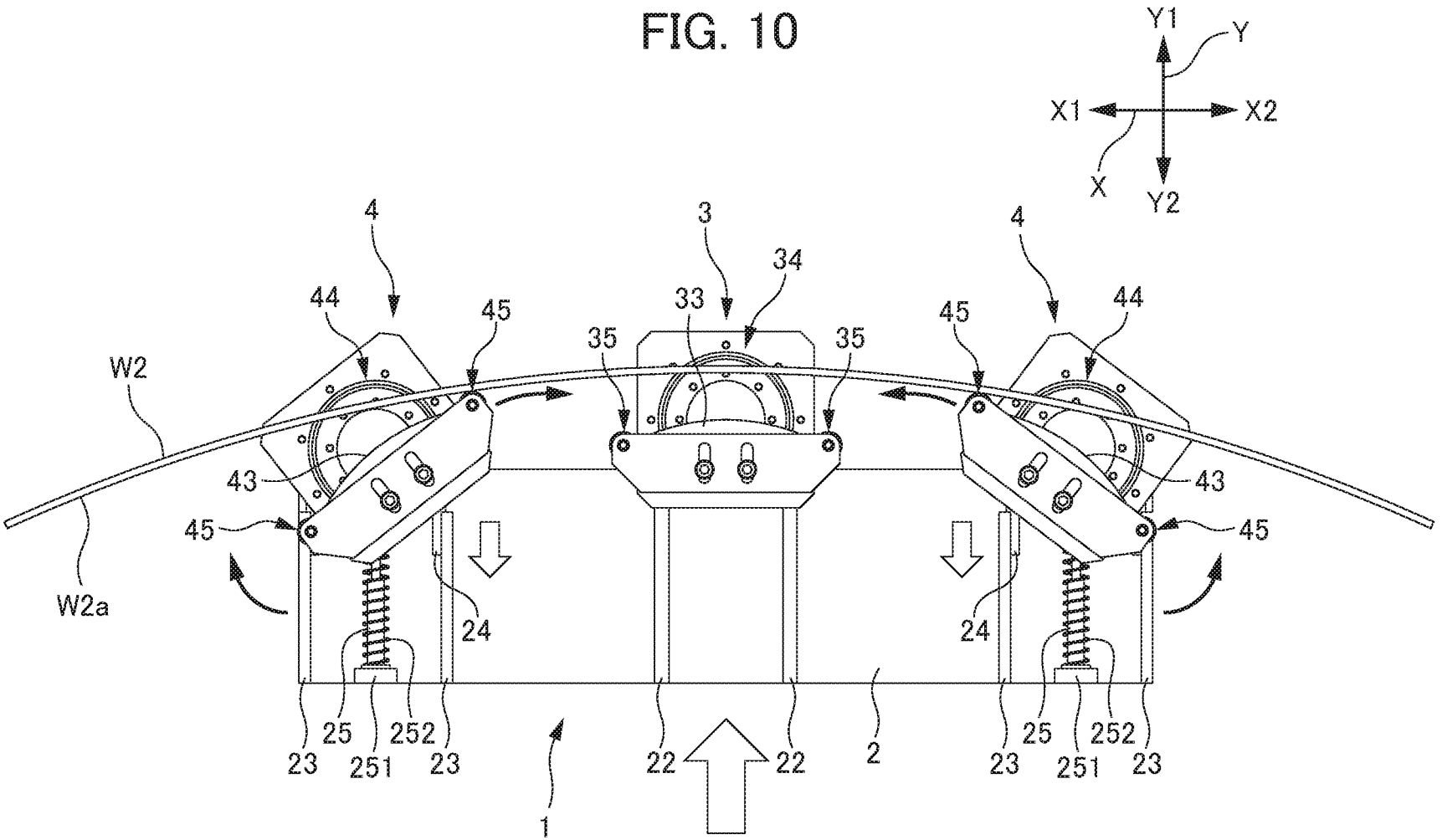
FIG. 10 is a bottom view showing processing of supporting the second workpiece having a different curvature after supporting the first workpiece by the workpiece receiving and supporting device according to an embodiment of the present disclosure.

After the completion of conveyance of the first workpiece W1, the workpiece receiving and supporting device 1 returns to the workpiece placing portion 100 for repetitive operation, and thereafter performs the support operation of the second workpiece W2. At this time, as shown in FIG. 9, the surface copying members 4 and 4 of the workpiece receiving and supporting device 1 return to the initial position at which they protrude most in the Y1 direction by the biasing force of the coil springs 252 and 252. However, the surface copying members 4 and 4 maintain a state being rotated by approximately 45 degrees in opposite directions with respect to the initial state, respectively, in accordance with the curved surface of the first workpiece W1 which is initially supported. Since the curvature of the second workpiece W2 is smaller than the curvature of the first workpiece W1, when the workpiece receiving and supporting device 1 moves toward the second workpiece W2, as shown in FIG. 10, the sliding portions 45 and 45 disposed on the surface copying members 4 and 4 on the positioning member 3 side first contact the concave curved surface W2*a* of the second workpiece W2.

Figure 11:
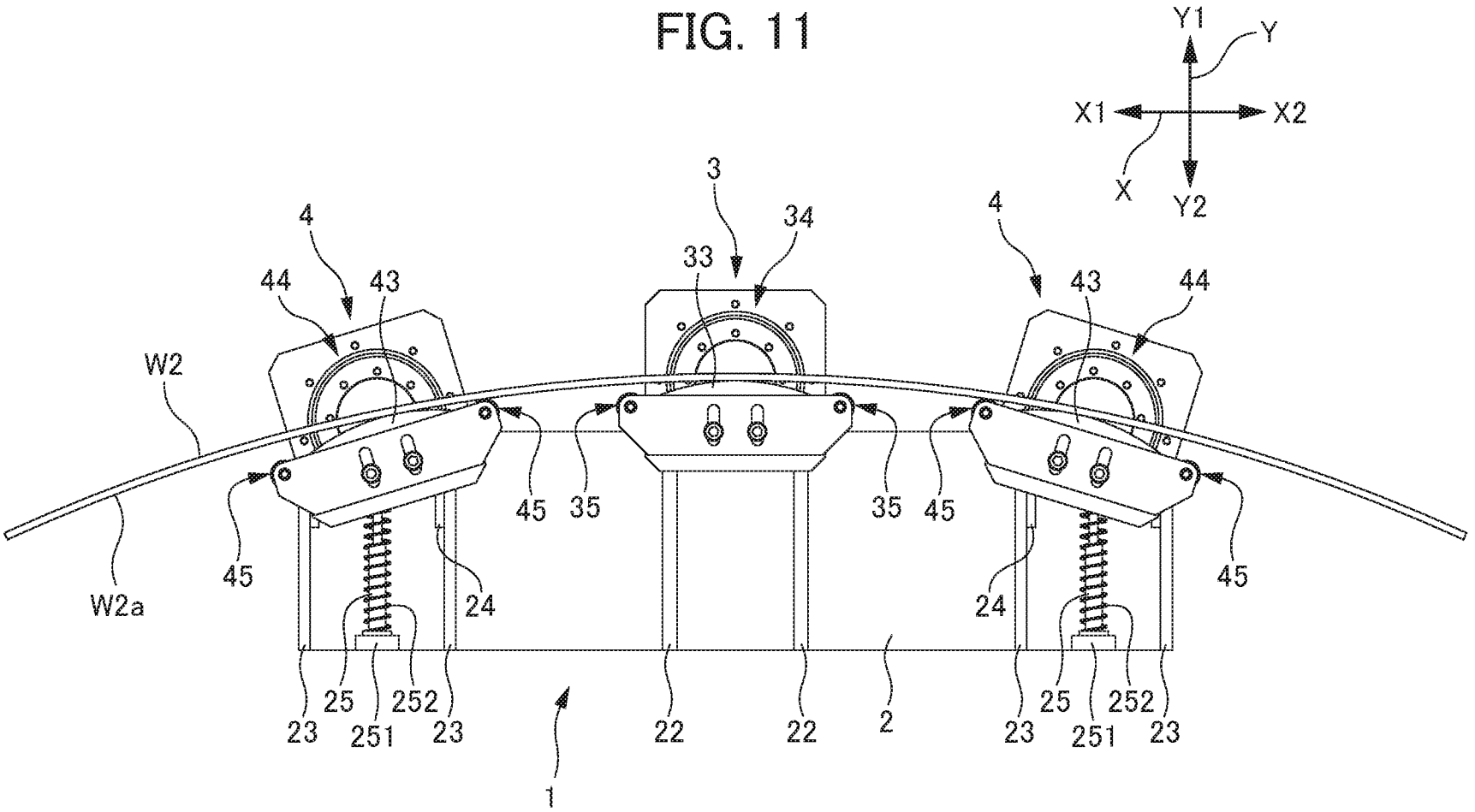
FIG. 11 is a bottom view showing a state supporting the second workpiece having a different curvature after supporting the first workpiece by the workpiece receiving and supporting device according to an embodiment of the present disclosure.

When the workpiece receiving and supporting device 1 further moves in the Y1 direction after the sliding portions 45 and 45 disposed on the positioning member 3 side of the surface copying members 4 and 4 respectively contact the concave curved surface W2*a* of the second workpiece W2, the sliding portions 45 and 45 smoothly slide (roll) toward the center portion in the width direction (the X direction) of the second workpiece W2 following the concave curved surface W2*a* of the second workpiece W2 by the rotation of the rollers 451 and 451. As a result, the surface copying members 4 and 4 move to rotate around the axis C2 (see FIG. 1) by the rotating mechanism 44 so that the contact portions 43 and 43 face the concave curved surface W2*a*. At the same time, the surface copying member 4 and 4 are pressed against the second workpiece W2 to compress the coil springs 252 and 252, and gradually linearly move in the Y2 direction along the guide rails 23 and 23. Therefore, as shown in FIG. 11, when the contact portion 33 of the positioning member 3 contacts the concave curved surface W2*a* of the second workpiece W2, the surface copying members 4 and 4 also allow the contact portions 43 and 43 to contact the concave curved surface W2*a*.

Therefore, even when, subsequent to the first workpiece W1, the second workpiece W2 having a curvature different from the curvature of the first workpiece W1 is contacted and supported, the workpiece receiving and supporting device 1 can smoothly rotate and move the surface copying members 4 and 4 to cause the contact portions 43 and 43 to face the concave curved surface W2*a* of the second workpiece W2. Therefore, even when subsequently contacting and supporting a plurality of workpieces having a plurality of types of different non-flat surfaces by repetitive operation, it is possible for the workpiece receiving and supporting device 1 to more reliably support each workpiece.

It should be noted that, in the support operation of the first workpiece W1 and the second workpiece W2 described above, since the positioning member 3 contacts against the central portion of each of the workpiece W1, W2, the positioning member 3 does not move to rotate. However, similarly to the surface copying member 4, the positioning member 3 can also move to rotate about the axis C1 (see FIG. 1) by the sliding portion 35 smoothly sliding (rolling) in accordance with the surface of the workpiece, depending on the curvature, the shape, or the like of the workpiece.

In the workpiece receiving and supporting device 1, it suffices if each of the sliding portions 35 and 45 of the positioning member 3 and the surface copying member 4 is configured so as to be slidable in accordance with the surface of the workpiece when in contact with the workpiece, and thus, is not limited to those configured by the rollers 351 and 451. The sliding portions 35 and 45 may be configured by members 353 and 453 having an easy sliding property with respect to the workpiece.

Figure 12:
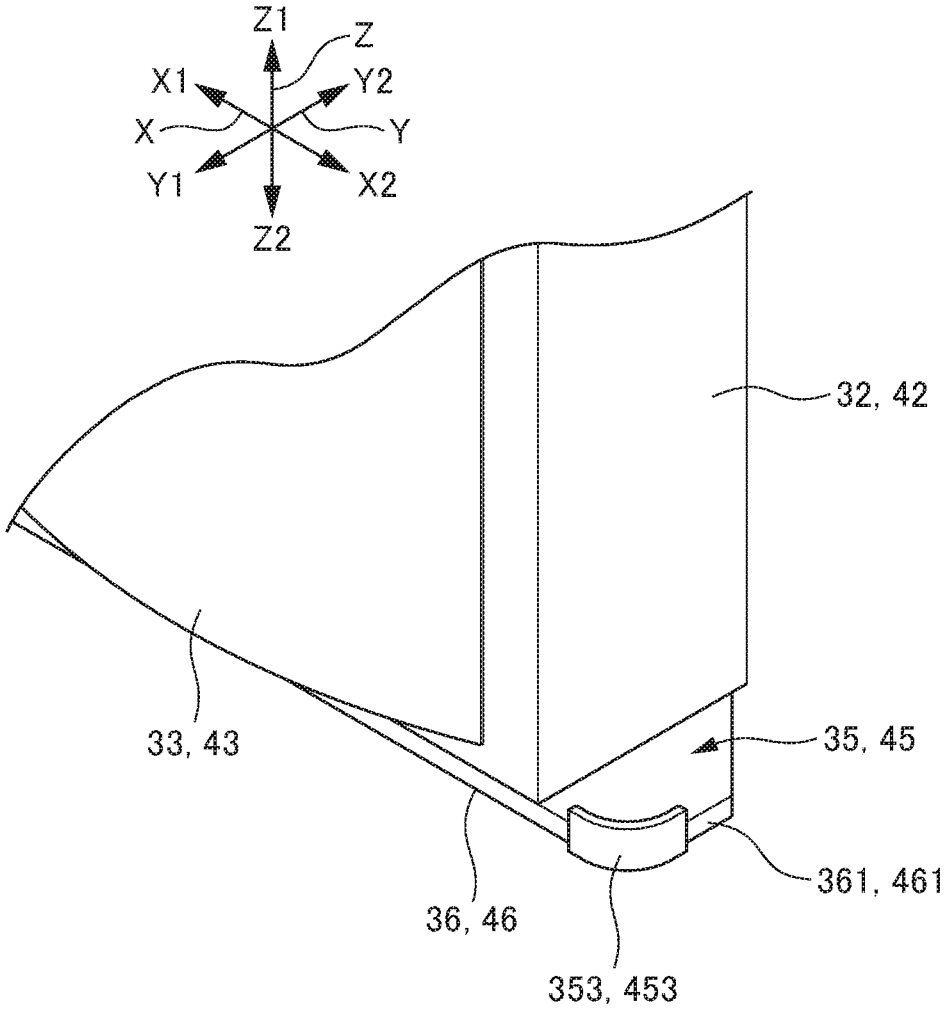
FIG. 12 is an enlarged view showing a common part of a positioning member and a surface copying member in a workpiece receiving support device according to another embodiment of the present disclosure.

The sliding portions 35 and 45 configured by the members 353 and 453 having an easy sliding property are formed of, for example, a resin material having little slip resistance such as PTFE(polytetrafluoroethylene), POM(polyacetal), PA(polyamide), or PPS(polyphenylene sulfide) so that the contact surface with the workpiece becomes a smooth curved surface as shown in FIG. 12. Furthermore, the sliding portions 35 and 45 configured by the members 353 and 453 having an easy sliding property may be formed by coating a resin material having little slip resistance described above on the surface of an appropriate metal or resin, or alternatively may be formed by mirror-finishing the metal surface.

Figure 13:
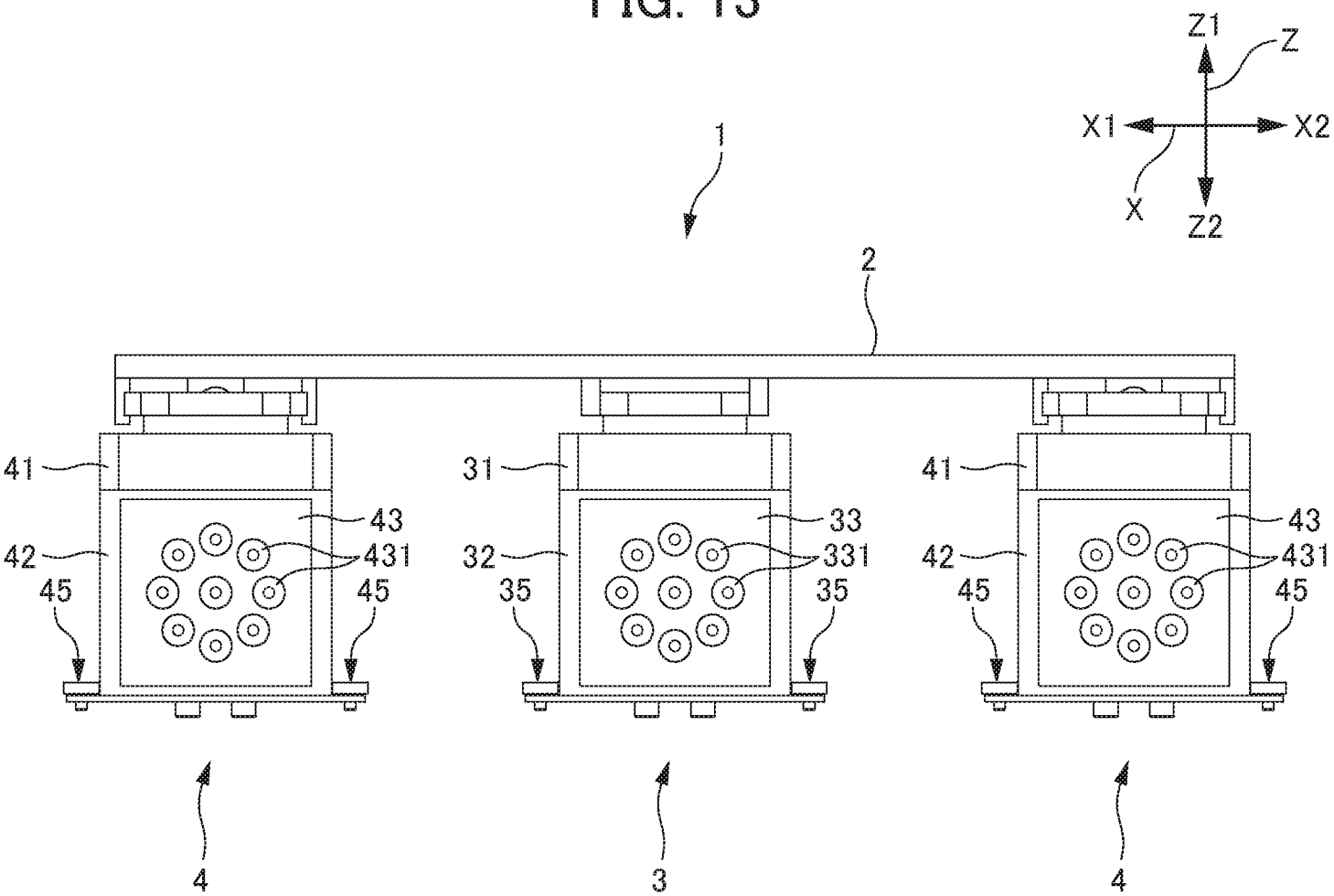
FIG. 13 is a front view showing a workpiece receiving and supporting device according to another embodiment of the present disclosure.

When a workpiece supported by the workpiece receiving and supporting device 1 is gripped or supported by another device at a conveyance destination, the contact portions 33 and 43 of the positioning member 3 and the surface copying member 4 may have one or a plurality of suckers 331 and 431 for suctioning and supporting the workpiece by negative pressure, respectively, as shown in FIG. 13.

In addition, although not shown, the contact portions 33 and 43 of the positioning member 3 and the surface copying member 4 may have a plurality of suction holes, and may be configured to suck and suction, and support the workpiece by suctioning air from the suction holes.

In the workpiece receiving and supporting device 1, the surface copying member 4 may be configured to adjust the position in the width direction (the X direction) of the common substrate 2 so as to be disposed at an optimal position according to the size, the curvature, etc. of the workpiece.

In the workpiece receiving and supporting device 1, the positioning member 3 is not limited to those configured not to move linearly in the Y direction with respect to the common substrate 2 and, similarly to the surface copying member 4, the positioning member 3 may be configured to be linearly movable in the Y direction with respect to the common substrate 2.

The workpiece supported by the workpiece receiving and supporting device 1 is not limited to being made of metal, and may be made of a non-metal such as a glass plate. In a case of supporting a non-metallic workpiece, each of the contact portions 33 and 43 is configured to suction and support the workpiece by suction of a sucker or a negative pressure.

Furthermore, the workpiece supported by the workpiece receiving and supporting device 1 is not limited to those having a shape with one curved surface of an arc shape such as the first workpiece W1 and the second workpiece W2, and it suffices if the workpiece has at least one of at least one type of shapes among a curved surface and inclined surface where a plurality of flat surfaces intersect, on the workpiece surface supported by the workpiece receiving and supporting device 1.

EXPLANATION OF REFERENCE NUMERALS

1 workpiece receiving and supporting device
3 positioning member
4 surface copying member
33,43 contact portion
35,45 sliding portion
331,431 sucker
351,451 roller (rotating member)
353,453 member
W1 first workpiece
W2 second workpiece

What is claimed is:

1. A workpiece receiving and supporting device comprising:

at least one positioning member that is configured to contact a workpiece and position the workpiece; and a plurality of surface copying members, each of the surface copying members being configured to contact the workpiece when the workpiece has been positioned by the positioning member, each of the surface copying members being configured to be rotationally movable and linearly movable with respect to a surface of the workpiece, wherein each of the at least one positioning member and the plurality of surface copying members include at least a contact portion that is configured to contact the workpiece and support the workpiece, and each of the at least one positioning member and the plurality of surface copying members further includes at least two sliding portions that are slidable with respect to the surface of the workpiece when each respective sliding portion contacts the surface of the workpiece, and wherein each contact portion is located between two respective sliding portions on each of the at least one positioning member and the plurality of surface copying members.

2. The workpiece receiving and supporting device according to claim 1, wherein each of the sliding portions comprises a rotating member that is rotatable by contact with the workpiece.

3. The workpiece receiving and supporting device according to claim 1, wherein each of the sliding portions comprises a member having a sliding property with respect to the workpiece.

4. The workpiece receiving and supporting device according to claim 1, wherein the contact portion includes a magnet that attracts the workpiece by way of magnetic force.

5. The workpiece receiving and supporting device according to claim 1, wherein the contact portion includes a sucker that suctions the workpiece by way of negative pressure.

* * * * *